United States Patent [19]

Torgersen

[11] Patent Number: 4,546,920

[45] Date of Patent: Oct. 15, 1985

[54] SONIC WATER JET NOZZLE

[75] Inventor: Robert H. Torgersen, Canoga Park, Calif.

[73] Assignee: Automation Industries, Inc., Greenwich, Conn.

[21] Appl. No.: 544,398

[22] Filed: Oct. 21, 1983

[51] Int. Cl.[4] ..... B05B 17/06

[52] U.S. Cl. ..... 239/102; 239/590.5

[58] Field of Search ..... 239/102, 101, 106, 499, 239/4, 461, 590.5, 600

[56] References Cited

U.S. PATENT DOCUMENTS 4,004,736 1/1977 George ..... 239/102

4,393,991 7/1983 Jeffras et al. ..... 239/102

*Primary Examiner*—James B. Marbert

*Attorney, Agent, or Firm*—Thomas L. Flattery

[57] ABSTRACT

A nozzle construction includes a housing having an elongated opening with an end that terminates in a reflector for redirecting ultrasonic signals along a desired direction of transmission. In the same housing, a sonic transducer directs sonic energy toward the reflector, which, after reflection, enters the conical nozzle and leaves the apparatus via a solid liquid stream for acting upon a test piece. Sets of fins are optionally located in the passageway for breaking up any tendency of the liquid to swirl which has been found to degrade the projected liquid column. A further set of fins located in the conical nozzle removes any swirling tendencies introduced between the cylindrical passage and the conical nozzle.

9 Claims, 7 Drawing Figures

FIG. 4.
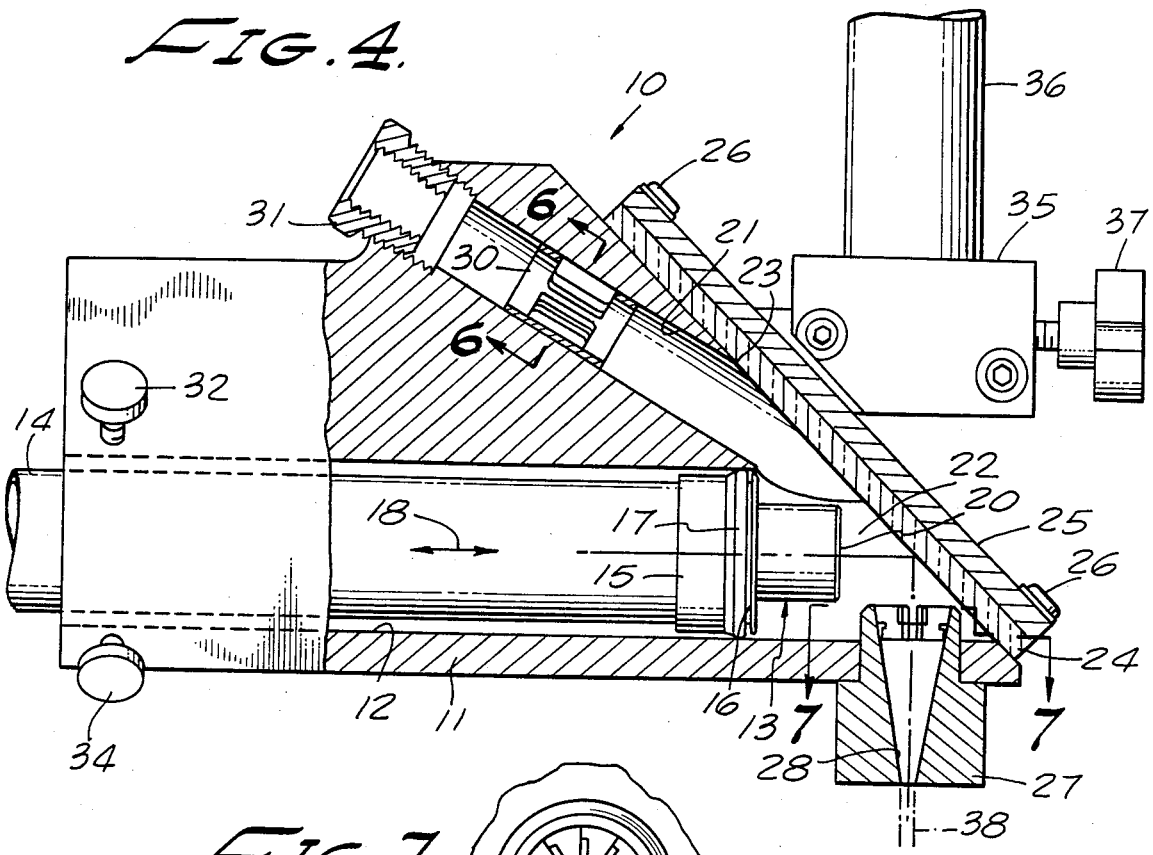
FIG. 7.
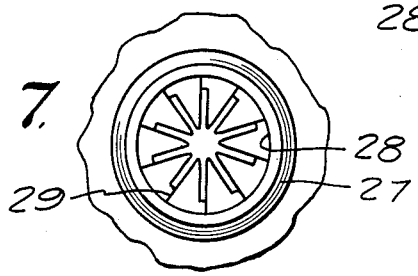
FIG. 5.
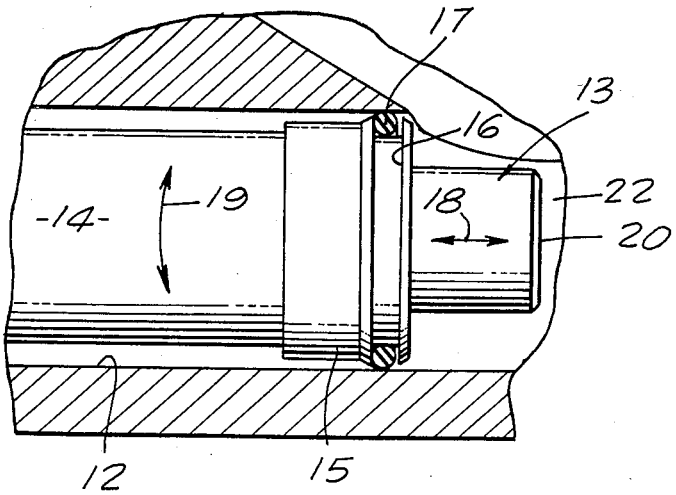
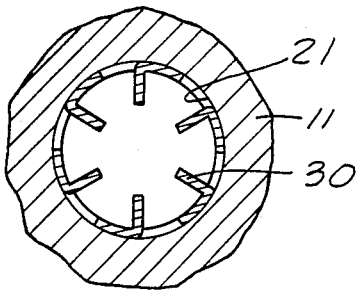
FIG. 6.

SONIC WATER JET NOZZLE

The present invention relates generally to sonic liquid jet nozzle and, more particularly, to an improved nozzle apparatus for emitting a laminar column of water substantially free from surface irregularities over an extended length and along which sonic energy passes.

BACKGROUND

Sonic and especially ultrasonic energy is increasingly utilized in the non-destructive inspection or testing of parts for defects. A typical form of such testing or inspection apparatus provides a quantity of liquid (e.g., water) on the part to be tested as a coupling means for sonic energy generated by a remotely located transducer. It has been found that even a very small amount of irregularities in the surface of the projected liquid column produces sonic reflections and refractions which result in loss of sonic energy through the walls of the projected liquid column to the test piece reducing operational efficiency.

U.S. Pat. No. 4,393,991, Sonic Water Jet Nozzle, by N. B. Jeffras and R. H. Torgersen includes an elongated generally tapering nozzle with a larger end of which a sonic transducer is located. A plurality of openings in surrounding relationship to a transducer that inhibits rotation of a liquid which encompasses the vibrating face of the transducer and which fills the internal nozzle parts in a continuously moving stream. Fin-like means are located at an intermediate location along the tapering passageway through the nozzle to further reduce the stream degradation caused by rotating or swirling. As a result of this patented construction, a highly uniform flow of liquid is provided along which pulsating sonic energy can be transmitted from the transducer to the surface of the test piece. A homogeneous or solid stream of liquid is produced with this patented device which is almost twice as long as that projected by prior known devices.

Although substantial improvement over known prior devices is achieved, the patented device requires that the sonic transducer and liquid column must be coaxial which may be inconvenient or impossible in certain use situations.

SUMMARY

In the practice of the described disclosure, a nozzle construction is provided which includes a nozzle construction is provided which includes a housing having an elongated opening with an end that terminates upon a reflector plate for redirecting a desired direction of transmission. In the same housing, a further passageway is provided within which a sonic transducer is located for directing sonic energy toward the reflector plate, which, after reflection, enters the conical nozzle and leaves the apparatus via a solid liquid stream for acting upon a test piece. A set of fins is located in the cylindrical passageway for breaking up any tendency of the liquid to swirl, which swirling has been found in the past to degrade the projected liquid column by centrifugal forces that break up the smooth surface. A further set of fins is located in the conical nozzle to remove any swirling tendencies introduced between the cylindrical passage and the conical nozzle.

DESCRIPTION OF THE DRAWINGS

FIG. 4 is a side elevational, partially sectional view taken along the line 4—4 of FIG. 1.

FIG. 5 is an enlarged, side elevational, partially fragmentary view showing the sonic transducer and adjustability means therefor.

FIG. 6 is a sectional elevational view taken along the line 6—6 of FIG. 4.

FIG. 7 is a sectional elevational view taken along the line 7—7 of FIG. 4.

DESCRIPTION OF A PREFERRED EMBODIMENT

Figure 1:
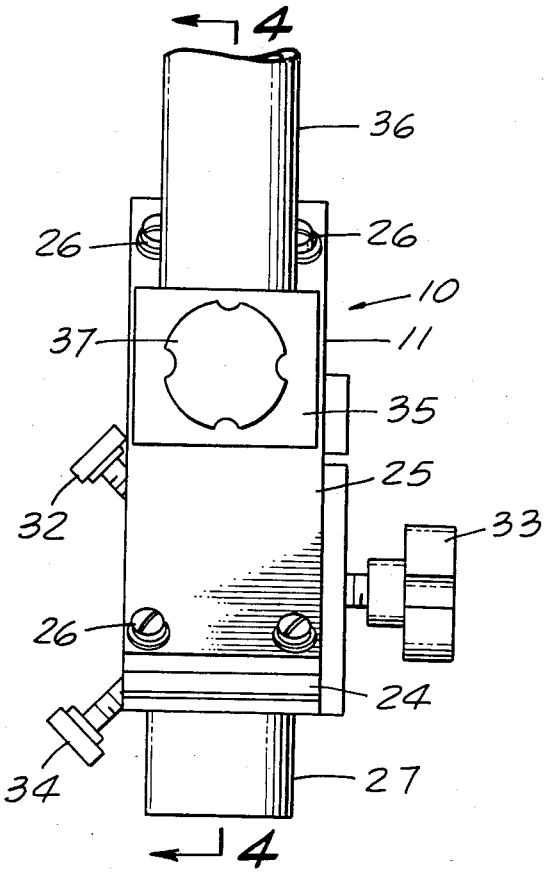
FIG. 1 is a right end view of the described sonic liquid jet nozzle.

With reference now to the drawings, and particularly FIG. 4, the sonic water jet nozzle of this invention enumerated generally as at 10 is seen to include a housing 11 including a generally cylindrical elongated passageway 12 within which is mounted a sonic transducer which is located on the end of a pipe or tube 14. The end of the pipe 14 includes a cap-like structure 15 affixed thereto having a circumferential groove 16 formed therein within which an O-ring 17 is located. Thus, the sonic transducer 13 can be adjusted longitudinally of the opening 12 (arrows 18) and may be rotated therein (arrows 19) for a purpose to be described. The vibrating face 20 of the transducer extends generally transversely of the opening 12.

A further cylindrical opening or passageway 21 in the housing 11 extends angularly to the first described cylindrical passage 12 with the two intercepting each other in a common chamber 22. More particularly, the housing wall has been removed such that the common chamber 22 communicating with both opening 12 and passageway 21 has an open side indicated as at 23. A reflector plate 24 preferably stainless steel with a backup plate 25 are arranged as a composite over the opening 23 and secured to the housing 11 by threaded members 26.

A nozzle body 27 having a conical passageway 28 therethrough is received within a wall of a housing 11 in such an arrangement that sonic energy moving along the transducer axis on reflection from the reflector plate moves into the concave passageway centered on its axis. An anti-swirl means 29 located within the nozzle body passageway 28 has a set of radially inwardly extending fins for reducing the tendency of water passing therethrough to rotate. The center of this set of fins is open to permit free passage of the central concentrated portion of the ultrasonic signal.

Optionally, a further anti-swirl means 30 is located within the passageway 21 substantially midway along its full length. Specifically, this anti-swirl means consists of a hollow, generally cylindrical band having portions cut out that extend inwardly forming a set of fins as shown best in FIG. 6. The fins extend only part way towards the center leaving an unobstructed central portion for liquid flow passing therethrough. The anti-swirl means is more specifically described in the referenced U.S. Pat. No. 4,393,991. A fitting 31 is threaded into the outer end of the passageway 21 for interconnection with a source of pressurized liquid (not shown). It is contemplated that this additional anti-swirl means would be useful for unusually highpressure liquid.

Figure 2:
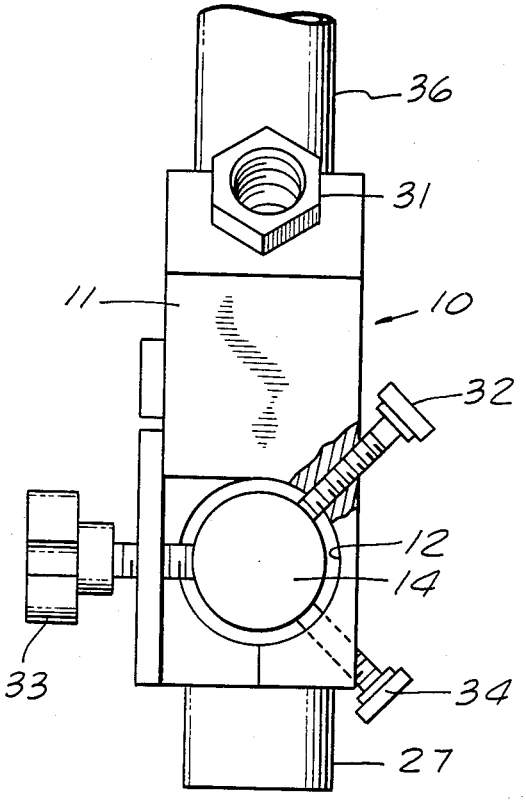
FIG. 2 is a left end view of the apparatus of FIG. 1.
Figure 3:
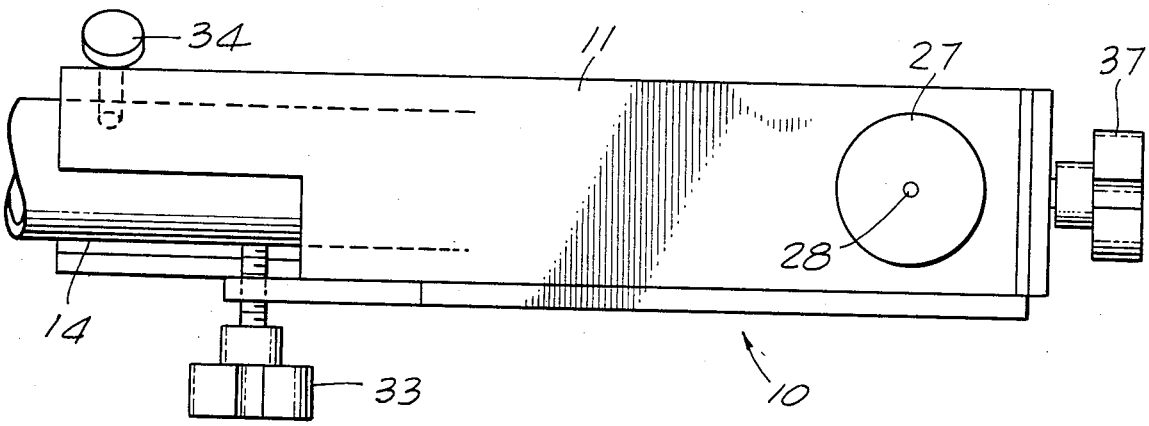
FIG. 3 is a further bottom plan view.

Three positioning screws 32–34 are threaded into housing 11 so that their inner ends contact the tube 14 at points 120 degrees apart (FIG. 2). As seen best in FIG. 3, the screws 32 and 34 are in the same plane passing transversely through tube 14, while screw 33 is spaced along the tube axis from the plane of screws 32 and 34.

A journal box 35 interrelates the housing 11 and described apparatus integral therewith to a support member 36. In this manner, the entire apparatus may be precisely located angularly about the support to direct the liquid stream, and sonic energy moving therealong, onto the test piece. A stop screw 37 fixedly locates the journal at any desired angular orientation about the support member 36.

In use of a practical construction, the entire apparatus is typically located on a scanning mechanism after which the stop screw 37 is tightened. The scanning mechanism locates the apparatus appropriately at the workpiece. Pressurized liquid is then applied through fitting 31 completely filling passageway 21 and chamber 22, and exiting from the nozzle body 27 as a solid stream 38 of liquid to impinge on the workpiece (not shown). The sonic transducer 13 is then energized causing sonic energy to be directed toward the glass plate 24 where it is reflected into conical chamber 28 and transmitted outwardly along the solid stream 38 to act upon the workpiece.

It is advantageous on initially setting up the described apparatus to move the transducer 13 along opening 12 in the direction of arrows 18 to "tune" the sonic energy so the natural focus point is at the nozzle orifice and beginning of the projected solid stream to produce the most efficient results. It also will on occasion be necessary to adjust screws 32–34 to insure that the sonic energy reflected from the reflector plate is aligned and centered on the axis of the solid stream 38.

I claim:

1. Sonic liquid jet nozzle, comprising:

a housing;

a first passageway within said housing having an external opening for interconnection with a source of pressurized liquid;

sonic energy reflector means having a surface in communication with the first passageway;

a second passageway in said housing communicating with said first passageway and said reflector means;

a source of sonic energy located in said second passageway for directing sonic energy onto said reflector means surface; and a nozzle body with a passageway aligned with the direction of reflected sonic energy extending therethrough mounted on said housing for receiving pressurized liquid and reflected sonic energy from said reflector means and for emitting the liquid and sonic energy exteriorly of the housing.

2. Sonic liquid jet nozzle as in claim 1, in which anti-swirl means are located in the nozzle body passageway.

3. Sonic liquid jet nozzle as in claim 2, in further anti-swirl means are located in the first passageway.

4. Sonic liquid jet nozzle as in claim 2, in which the first and second liquid anti-swirl means each include a plurality of fins to reduce the tendency of liquid moving along the first passageway and nozzle body passageway to rotate.

5. Sonic liquid jet nozzle as in claim 1, in which means are provided for adjustably locating the sonic energy source within the second passageway so that sonic energy reflected from the reflector means wil be centered along the nozzle body passageway.

6. Sonic liquid jet nozzle as in claim 4, in which the adjustably locating means includes threaded members extending through the housing and contacting the sonic energy source.

7. Sonic liquid jet nozzle as in claim 5, in which said adjustably locating means further includes means enabling the sonic energy source to be moved along the second passageway changing the spacing of said sonic energy source from the reflector means.

8. Sonic liquid jet nozzle as in claim 6, in which the enabling means includes an O-ring.

9. Sonic liquid jet nozzle as in claim 1, in which the reflector means includes a stainless steel plate.

* * * * *